US008113399B2

(12) United States Patent
Lee

(10) Patent No.: US 8,113,399 B2
(45) Date of Patent: Feb. 14, 2012

(54) BAG WITH CARRYING SYSTEM

(75) Inventor: Seung Sup Lee, Edgewater, NJ (US)

(73) Assignee: BBP Industries, LLC, West New York, NJ (US)

( * ) Notice: Subject to any disclaimer, the term of this patent is extended or adjusted under 35 U.S.C. 154(b) by 124 days.

(21) Appl. No.: 12/758,154

(22) Filed: Apr. 12, 2010

(65) Prior Publication Data

US 2010/0200632 A1 Aug. 12, 2010

Related U.S. Application Data

(63) Continuation of application No. 11/796,529, filed on Apr. 26, 2007, now abandoned.

(60) Provisional application No. 60/795,491, filed on Apr. 28, 2006.

(51) Int. Cl.
*A45F 3/02* (2006.01)
*A45F 3/04* (2006.01)

(52) U.S. Cl. ..... 224/578; 224/607; 224/617

(58) Field of Classification Search ..... 224/578, 224/579, 580, 607, 617
See application file for complete search history.

(56) References Cited

U.S. PATENT DOCUMENTS

| | | | | |
|---|---|---|---|---|
| 5,042,704 | A * | 8/1991 | Izzo | 224/643 |
| 5,577,652 | A * | 11/1996 | Cooper | 224/578 |
| 5,927,581 | A * | 7/1999 | Reddy et al. | 224/578 |
| 6,168,060 | B1 * | 1/2001 | Mayers | 224/645 |
| 6,915,932 | B1 * | 7/2005 | Wolfe | 224/264 |

* cited by examiner

*Primary Examiner* — Justin Larson
(74) *Attorney, Agent, or Firm* — Stamoulis & Weinblatt LLC

(57) ABSTRACT

A bag having a convertible carrying system that may convert from a single strap capable of being used to carry the bag to more than one strap portion capable of being used to carry the bag. In embodiments, the strap may be connected to the bag at its ends to form a single strap capable of being used to carry the bag and the strap may be folded at a mid-section and removably attached to the bag substantially at or near at the mid-section to form more than one strap portion capable of being used to carry the bag. In an embodiment, the bag may have a secondary strap attached to the strap substantially at or near the mid-section which is capable of helping to maintain the folding in the strap. In this manner, the bag may be carried by a user as a shoulder bag or as a backpack.

25 Claims, 11 Drawing Sheets

BAG WITH CARRYING SYSTEM

REFERENCE TO PRIORITY DOCUMENT

This application is a continuation of U.S. application Ser. No. 11/796,529, filed Apr. 26, 2007, now abandoned, which claims the benefit of U.S. Provisional Application No. 60/795,491, filed Apr. 28, 2006, the entire disclosures of which are incorporated herein by reference.

SUMMARY

Embodiments of the invention(s) relate to a bag with a carrying system, and more specifically to a bag having a convertible carrying system.

A bag having a convertible carrying system is described having several embodiments and variations. A carrying system and a method of converting a carrying system from a single strap to more than one strap portion are also described. One aspect of the carrying system is that it may provide more than one configuration for a user to carry the bag. In several embodiments, the carrying system may convert from a single strap capable of being used to carry the bag to more than one strap portion capable of being used to carry the bag. In an embodiment, the strap is connected to the bag at its ends to form a single strap capable of being used to carry the bag and removably attached to the bag at a mid-section to form more than one strap capable of being used to carry the bag. The strap may be folded at a mid-section and removably attached to the bag at a mid-section to form more than one strap capable of being used to carry the bag. In this manner, the bag may be carried by a user as a shoulder bag or as a backpack, according to an embodiment. In one or more embodiments, the bag may have padding or a padded compartment that is capable of providing padding between a user and the bag. In embodiments, the bag may have one or more compartments that may be sized to accept a laptop computer, MP3 player or other objects therein. In an embodiment, the bag may have a panel that allows a handle, such as a handle of a rolling style suitcase, to pass therethrough, allowing the bag to be carried by the handle. One aspect of the carrying system is that it is designed to attempt to reduce physical stress on a user from carrying the bag.

In one embodiment, one strap may be folded substantially in half to form a substantially "V" shape or bent substantially in half to form substantially a "U" shape. The halves of the one strap may form dual straps that go over the user's shoulders while the substantially "V" or "U" shape may rest on the center of the back of the user. The ends of this strap may be attached to the sides of the bag. At the bottom of the substantially "V" or "U" shape, a clip or loop may exist. A secondary strap may be attached to the clip or loop at an end and/or may be attached to the top and/or around or at the center location of the bag. When a user wears the bag in this embodiment, a clip or loop may also exist on the outer side of one of the straps near the front left chest of the user. In a second embodiment, the bag may be configured to detach the secondary strap from the substantially "V" or "U" shape and then unfolding and flattening the substantially "V" or "U" shape creating a single strap. In a third embodiment, the bag may be configured to detach from the secondary strap from the substantially "V" or "U" shape, unfolding the substantially "V" or "U" shape, and then attaching the clip or loop existing on one or more of the dual straps to a side of the bag. The bag may include padded and non-padded compartments, any number of which may be accessed individually. The bag may also have pads on the backside to provide extra cushioning against a user's body when the bag is worn.

BRIEF DESCRIPTION OF DRAWINGS

The invention(s) may best be understood by referring to the following description and accompanying drawings that are used to illustrate embodiments of the invention. In the drawings.

DETAILED DESCRIPTION

Embodiments of a bag and carrying system are described. In the following description, numerous specific details are set forth. However, it is understood that embodiments of the invention may be practiced without these specific details. In other instances, well-known circuits, structures and techniques have not been shown in detail in order not to obscure the understanding of this description.

Reference throughout this specification to "one embodiment" or "an embodiment" means that a particular feature, structure, or characteristic described in connection with the embodiment is included in at least one embodiment of the invention. Thus, the appearances of the phrases "in one embodiment" or "in an embodiment" in various places throughout this specification, are not necessarily all referring to the same embodiment. Furthermore, the particular features, structures, or characteristics may be combined in any suitable manner in one or more embodiments.

Figure 1:
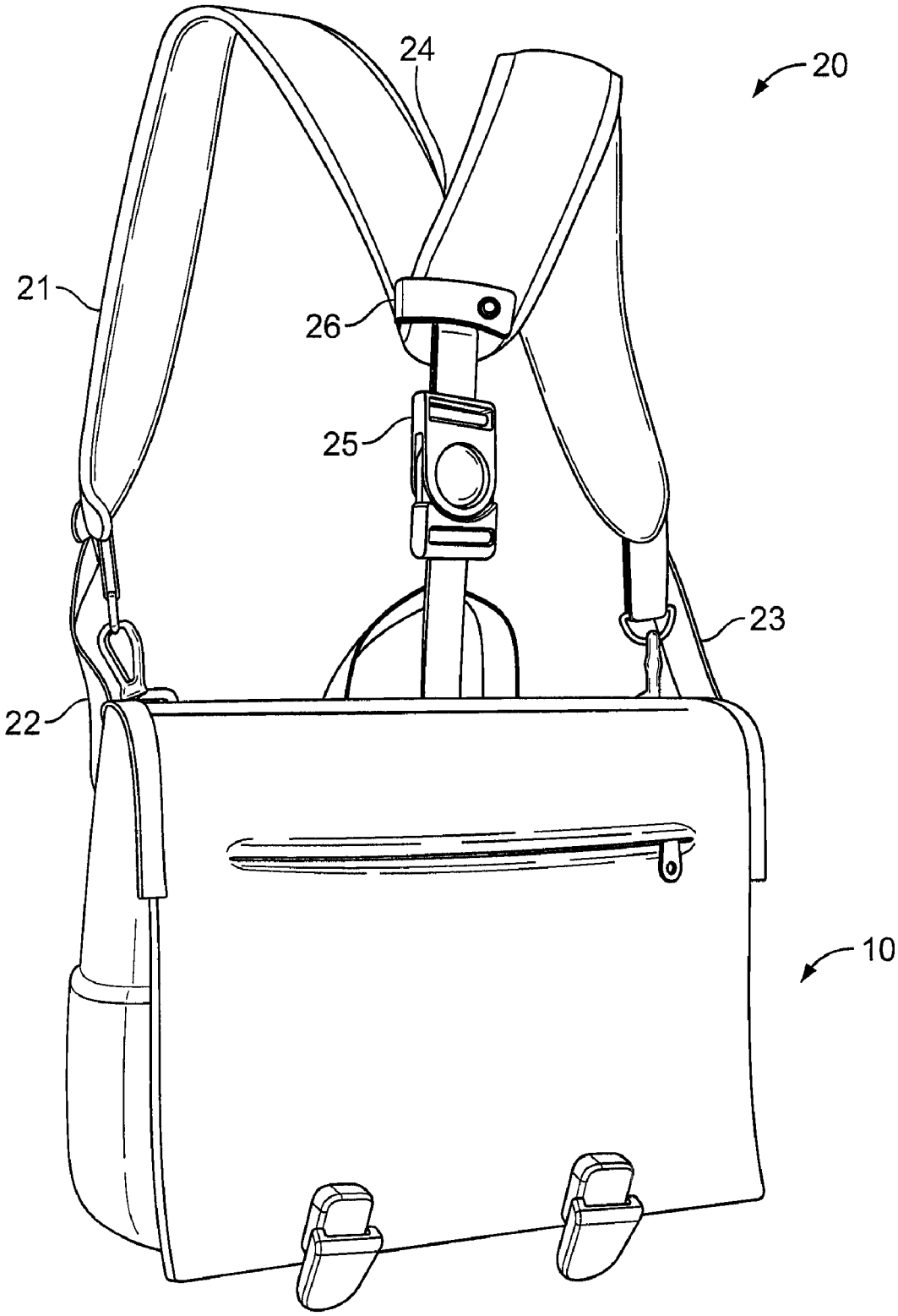
FIG. 1 is a front perspective view of a bag with a carrying system configured in a substantially "V" shaped fold illustrating one generalized embodiment.

Referring to FIG. 1, a front perspective view illustrates a bag 10 according to one embodiment. In an embodiment, bag 10 may have an approximate dimension of, for example, 16" W×11" H×6" D, and may be configured to carry objects such as a laptop computers, books, notebooks, MP3 players, papers, clothes, or other objects capable of being placed in the bag. Bag 10 may also include one or more compartments having dimensions smaller than bag 10 to protect the objects. In different embodiments, bag 10 may also have additional elements such as one or more of the following: organizer pockets, holders for electronic music playing devices, holders for water bottles, holders for keys and/or holders for writing devices such as pencils, pens or other objects. Bag 10 may be formed from a variety of textiles, including nylon, cotton, canvas, cotton/polyester blends, and other materials. In an embodiment, bag 10 may have a main or primary compartment and a secondary compartment which may be padded for helping to protect fragile objects placed therein. In an embodiment, the secondary compartment may be accessible via a zipper that is separate from the primary compartment. In an embodiment, the secondary compartment may have a protective lining such as, for example, a soft pliable lining. It may have one or more protective layers having, for example, a padded bottom, side, back, front, and top. It may also have one or more adjusters that may make the compartment smaller and which help to prevent objects from moving therein. Those of ordinary skill in the art will appreciate that the bag 10 may include more or fewer components than those shown in FIG. 1. However, it is not necessary that all of these generally conventional components be shown in order to disclose an illustrative embodiment for practicing the invention.

Figure 4:
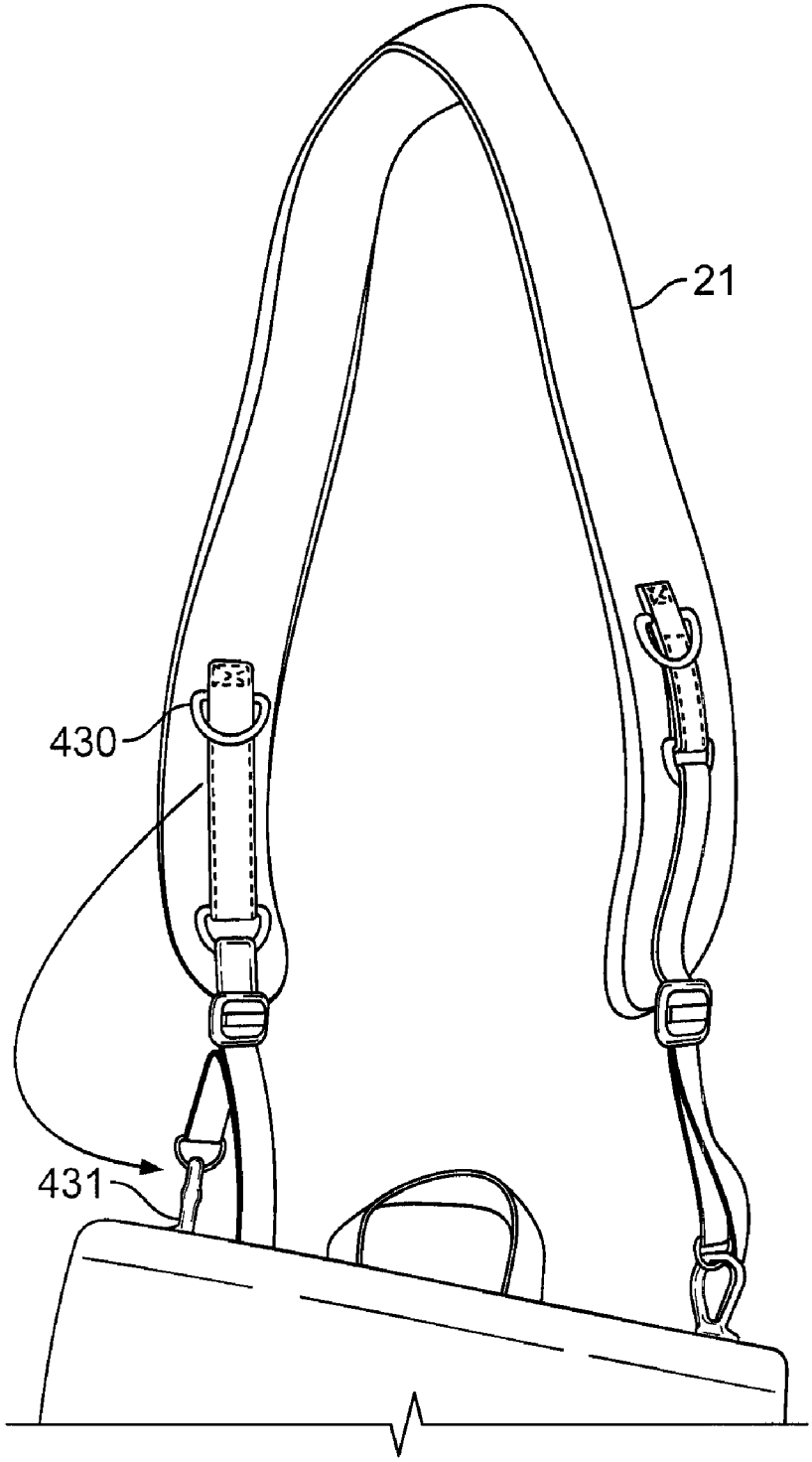
FIG. 4 is a front perspective view of the carrying system configured in a single shoulder strap embodiment.

Bag 10 of FIG. 1 has a carrying system 20. Carrying system 20 has a strap 21. In an embodiment, strap 21 may have padding, as also shown in FIG. 4. Strap 21 may be configured to form a single strap capable of being used to carry bag 10. In this configuration, bag 10 may be carried as a shoulder bag or in other manners. When configured to form a single strap, strap 21 is connected to bag 10 at its ends 22 and 23. In an embodiment, strap 21 may be connected to bag 10 at its ends 22 and 23 by removably attaching ends 22 and 23 to bag 10. In an embodiment, strap 21 may have rings attached or removably attached to ends 22 and 23 and may connect to bag 10 by using one or more clips, "J" hooks 431, swivel hooks, or other connectors or suitable means, as also shown in FIG. 4. In one embodiment, the strap 21 may be connected to the bag 10 by a swivel connection. A swivel connection may include, for example, two portions connected by a swivel. One portion is attached to the ends of the strap 21. The other portion is attached to the bag 10. The portion that attaches to the bag 10 may be wider than the portion connected to the ends of the strap 21, for example, to provide added strength to the bag connection. One or ordinary skill will appreciate that there are many ways of connecting ends 22 and 23 to bag 10 within the scope and spirit of the invention.

Figure 5:
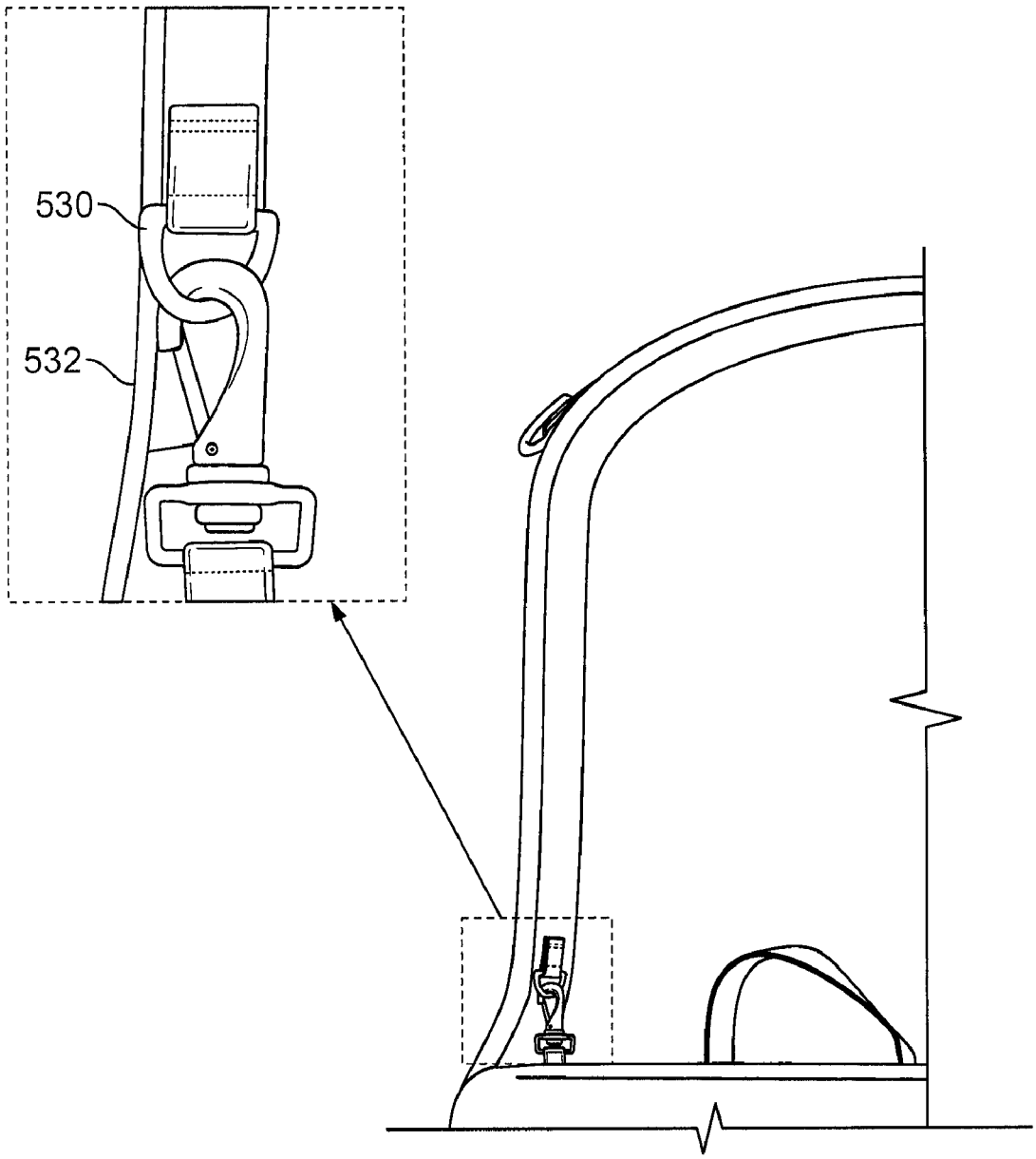
FIG. 5 is a front perspective view of the carrying system configured in a single shoulder strap showing a clip and a ring.
Figure 6:
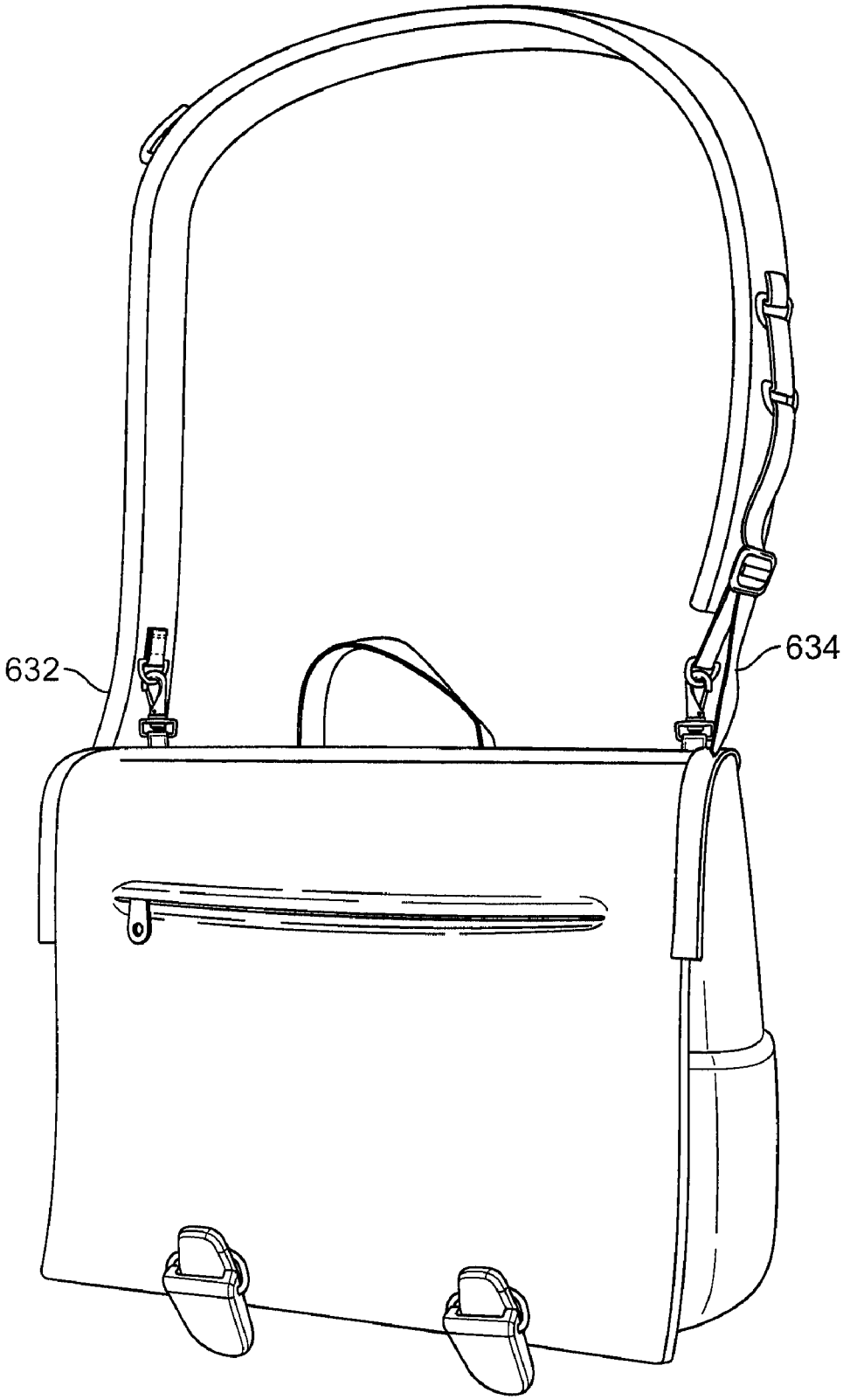
FIG. 6 is an front perspective view of the carrying system configured in a single shoulder strap showing a clip and a ring on an inside surface of the strap connected to shorten the strap according to one embodiment.

Strap 21 may also have components for adjusting its length. As shown in FIG. 4, in an embodiment, strap 21 may have one or more "D" rings 430, clips 431, slides or other adjusters or suitable means which may be used to adjust the length of strap 21. FIG. 5 shows bag 10 with strap 21 shortened in length by a clip 532 connected to a ring 530. FIG. 6 shows that a clip 632 is connected to a ring on one end of strap 21, and that there can be a similar clip 634 and ring on a second end of strap 21, which also may be connected to adjust the length of strap 21. FIG. 6 shows only one clip 632 connected to a ring, but a user may elect to connect both clips 632, 634 to rings, one clip 632 or 634 to a ring, or a user may chose to not connect any clips and rings at all. One of ordinary skill will appreciate that there are many ways and means for of adjusting the length of strap 21 within the spirit and scope of the invention.

Figure 7:
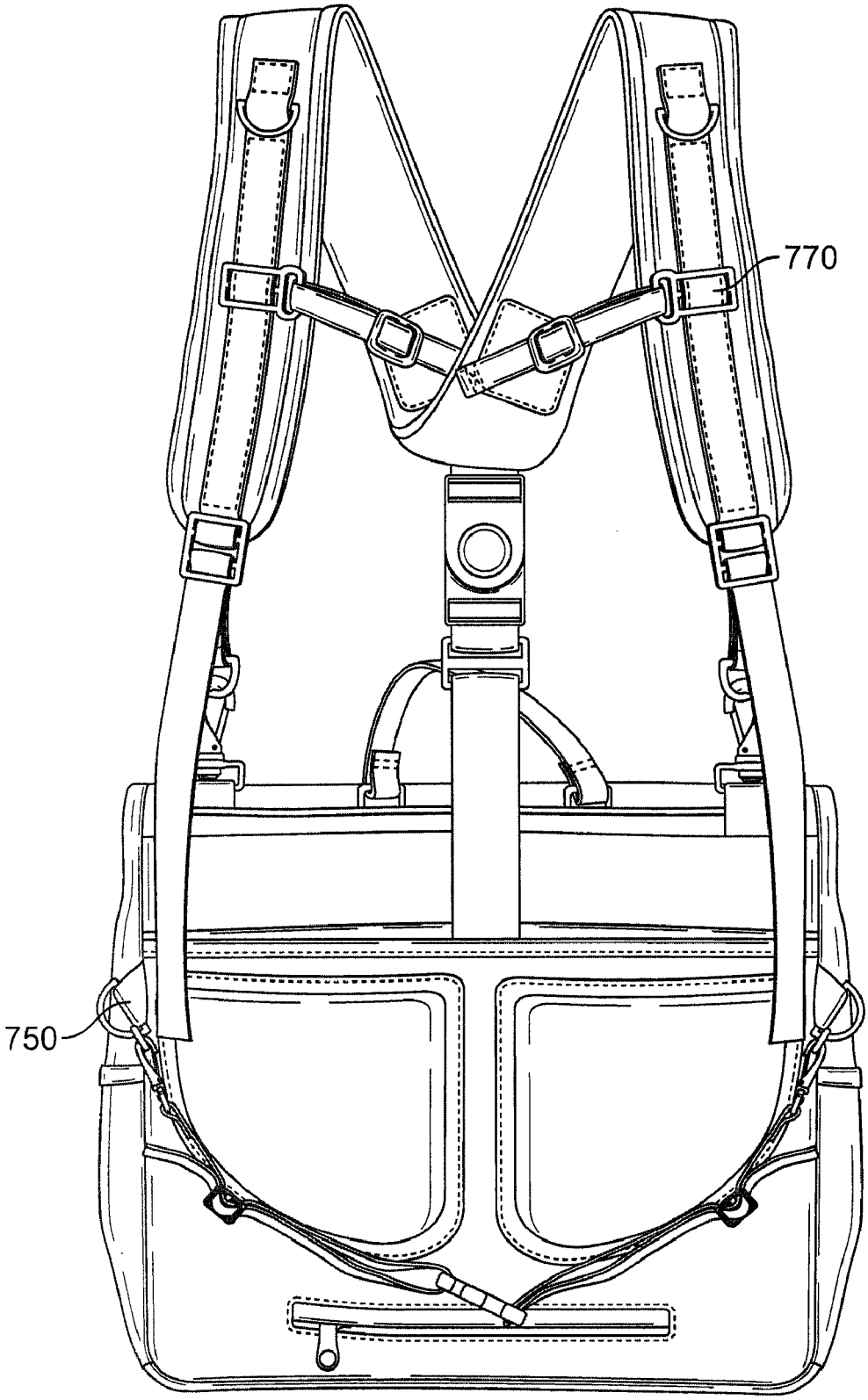
FIG. 7 is a back perspective view of a bag with a carrying system configured in a dual strap embodiment with a substantially "V" shaped fold with pads on the backside of the bag illustrating one generalized embodiment.

Strap 21 may also be configured to form more than one strap portion capable of being used to carry bag 10, as shown in FIG. 1. In an embodiment, when configured to form more than one strap portion capable of being used for carrying bag 10, strap 21 is folded at a mid-section 24 and mid-section 24 is connected to bag 10. Strap 21 is also connected at its ends 22 and 23 to bag 10, as described above. One of ordinary skill will appreciate that mid-section 24 may be located at different places on strap 21 and it not intended to be limited to the illustrative location depicted in FIG. 1. In an embodiment, strap 21 may be folded into substantially a "V" shape at mid-section 24. In another embodiment, strap 21 may be folded into substantially a "U" shape at mid-section 24. The angle formed by the two sides of the "V" or "U" shape fold (shown in FIG. 10 as angle $\alpha$) can vary. For example, the angle $\alpha$ of the "V" shape may be greater than about 0 degrees (the strap folded completely over on itself) and less than about 180 degrees (the strap being completely unfolded). Generally, the angle may be between at least about 40 degrees and at least about 100 degrees. In one embodiment, the angle is at least about 60 degrees. In another embodiment, the angle of the folded strap 21 is at least about 50 degrees. In another embodiment, the angle of the folded strap 21 is at least about 40 degrees, but not more than about 100 degrees. However, one of ordinary skill will appreciate that strap 21 may also be folded in other manners at mid-section 24. When configured in this manner, bag 10 may be carried as a backpack or in other manners. In an embodiment, strap 21 may also have a connecting strap 770 to connect the two strap portions across a user's sternum while being carried as a backpack, as shown in FIG. 7. Similarly, in an embodiment, there can be a connecting strap that may go around a user's waist.

Figure 10:
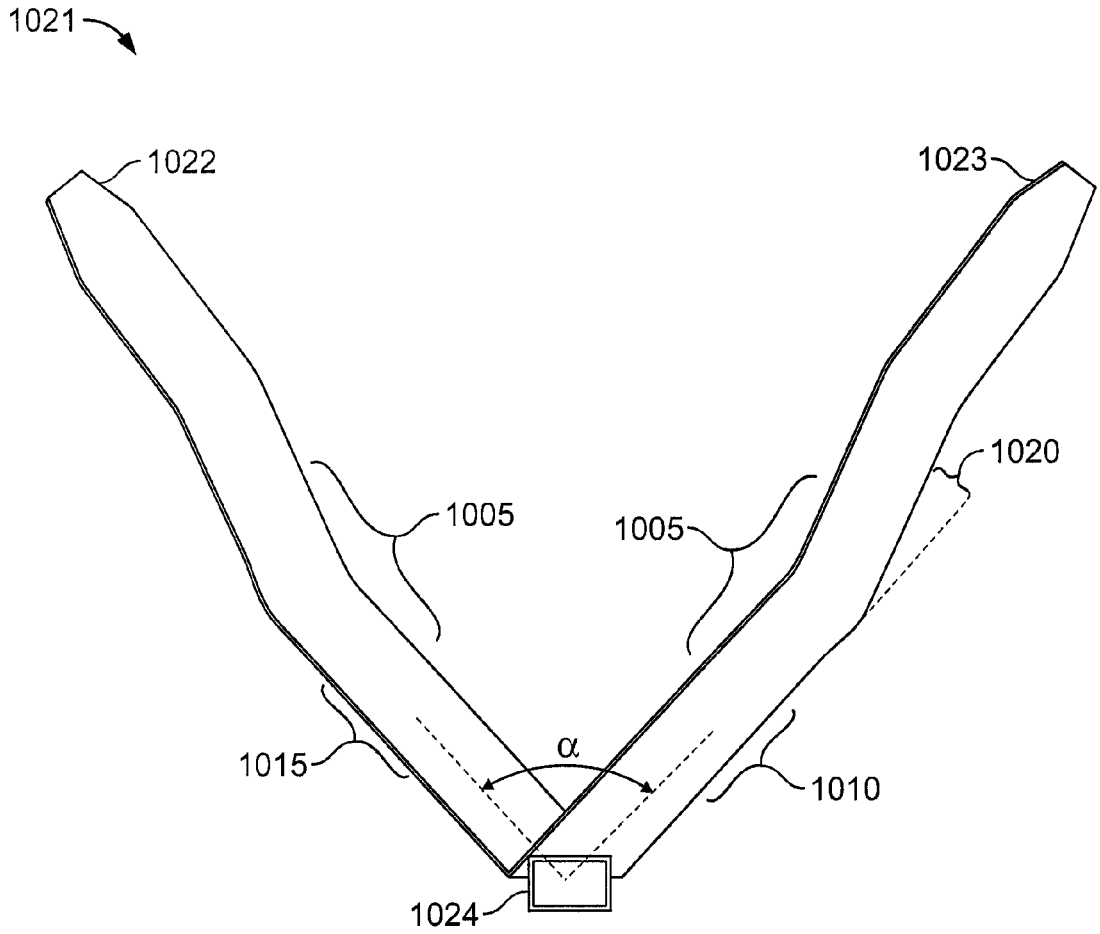
FIG. 10 is a schematic view of a strap configured to be used with a bag according to one generalized embodiment.

The shape of the strap can vary. For example, the strap can be uniform along its length or it can be tapered in portions. FIG. 10 shows a strap 1021 having tapered regions 1022, 1023 near the ends as well as more narrow regions 1010, 1015 near the mid-section 1024. When the strap 1021 is configured to form more than one strap portion in order to carry bag as a backpack, the portion of the strap 1021 nearest the armpit area can be narrower to maximize comfort of the wearer. Similarly, a portion(s) 1005 of the strap 1021 that is worn over the top of the shoulder in either the single strap configuration or the multi-strap configuration can be wider to provide added comfort to the wearer. The strap 1021 can also be straight or curved. In the curved configuration, for example, the strap 1021 could have a bend 1020 such as an about 20 degree bend near the portion of the strap 1021 that rests on the top of the wearer's shoulder.

Figure 3A:
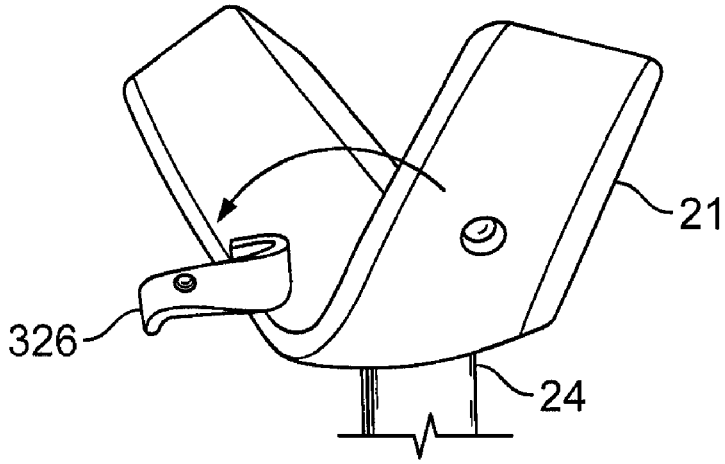
FIG. 3*a* is a front perspective view of the carrying system configured in a substantially "V" shaped fold according to an embodiment.

As shown in FIG. 1 and FIG. 3*a*, in an embodiment, there is a secondary strap 26 (326 in FIG. 3*a*) connected to strap 21 at or near mid-section 24. Secondary strap 26 may be used to help maintain the folding in strap 21 at mid-section 24. Secondary strap 26 may connect to strap 21 at a second place at or near mid-section 24 to keep the folding in place while strap 21 is configured to form more than one strap capable of being used for carrying bag 10. In an embodiment, secondary strap 26 may connect to the second place by a snap, Velcro, button or other suitable connectors or means.

Figure 2:
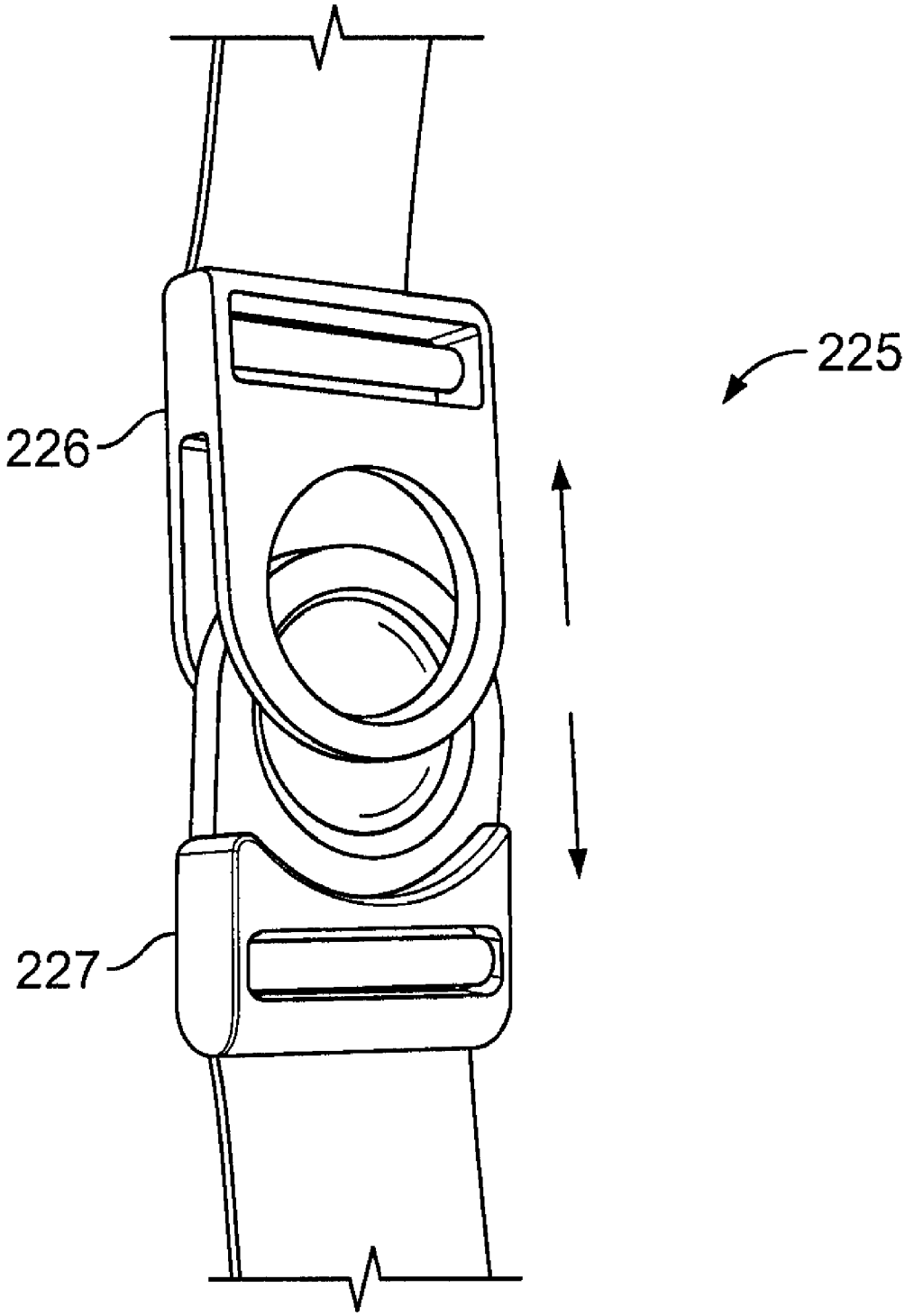
FIG. 2 is a front perspective view of a buckle of a carrying system according to an embodiment.
Figure 3B:
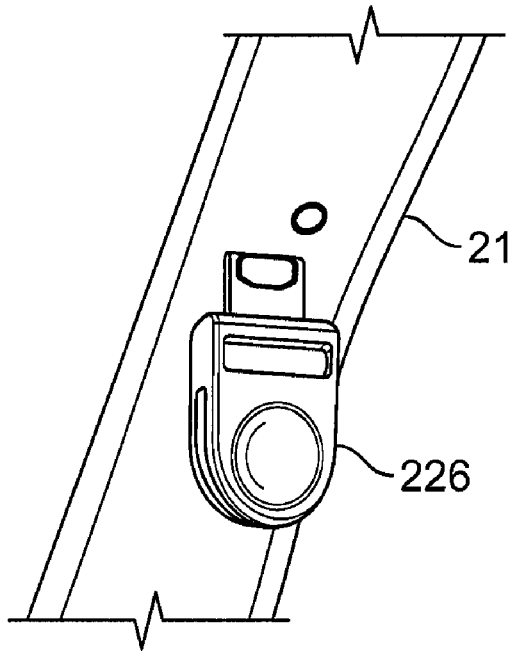
FIG. 3*b* is a front perspective view of the carrying system configured in a flattened or unfolded manner according to an embodiment.

In an embodiment, mid-section 24 may be removably connected or attached to bag 10 with a buckle 25 or other suitable connectors or means, such as snaps, Velcro, a clip, a loop, hook, swivel hook, or other connectors. One of ordinary skill will appreciate that there are various ways to removably connect mid-section 24 to bag 10 within the scope of spirit of the invention. FIG. 2 illustrates an embodiment of a buckle 225 which may be used to removably attach mid-section 24 to bag 10. Buckle 225 has two pieces, upper portion 226 connected to strap 21 and lower portion 227 connected to bag 10. Buckle 225 may be made from plastic, metal or other materials. As shown in FIG. 2, buckle 225 may be used to removably attach mid-section 24 to bag 10. Buckle 225 may release to detach mid-section 24 from bag 10. In an embodiment, buckle 25 may be attached to bag 10 and strap 21 with straps and these straps may have "D" rings or other adjusters or means that may be used to adjust their lengths. In this embodiment, when detached, upper portion 226 remains on strap 21, and when strap 21 is not folded at mid-section 24, upper portion 226 may lay flat along strap 21, as shown in FIG. 3*b*.

Figure 11:
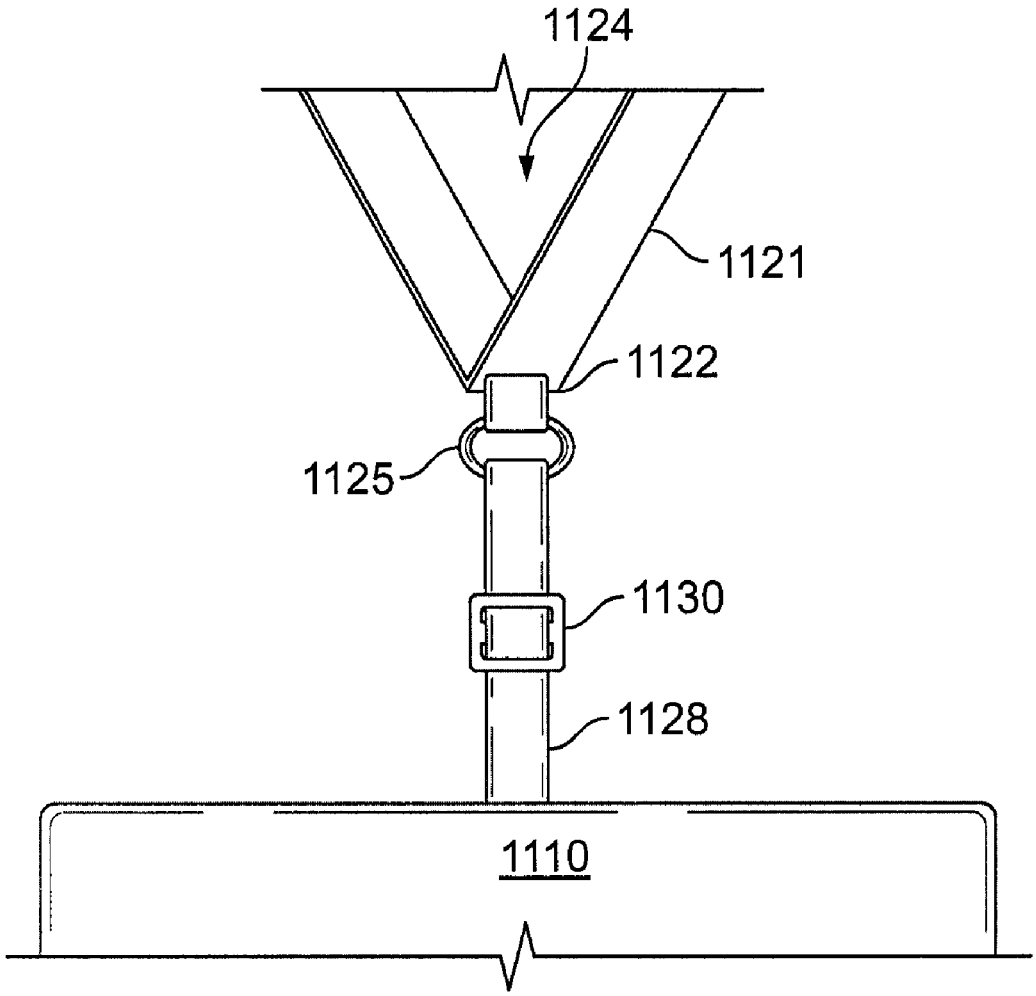
FIG. 11 is a schematic view of a bag with a carrying system configured in a substantially "V" shaped fold illustrating one generalized embodiment.

FIG. 11 illustrates another embodiment of the mid-section connection. The mid-section 1124 can be removably connected or attached to bag 1110 with a connection member 1125 such as a releasable loop, carabiner or other connection member instead of a buckle. The connection member 1125, for example, can be attached to the mid-section 1124 of the strap 1121 by a portion of material 1122 such as nylon webbing. The connection member 1125 can similarly attach to the bag 1110 by another portion of material 1128. The length of the portion of material 1128 can be adjustable such as by a buckle 1130.

Figure 8:
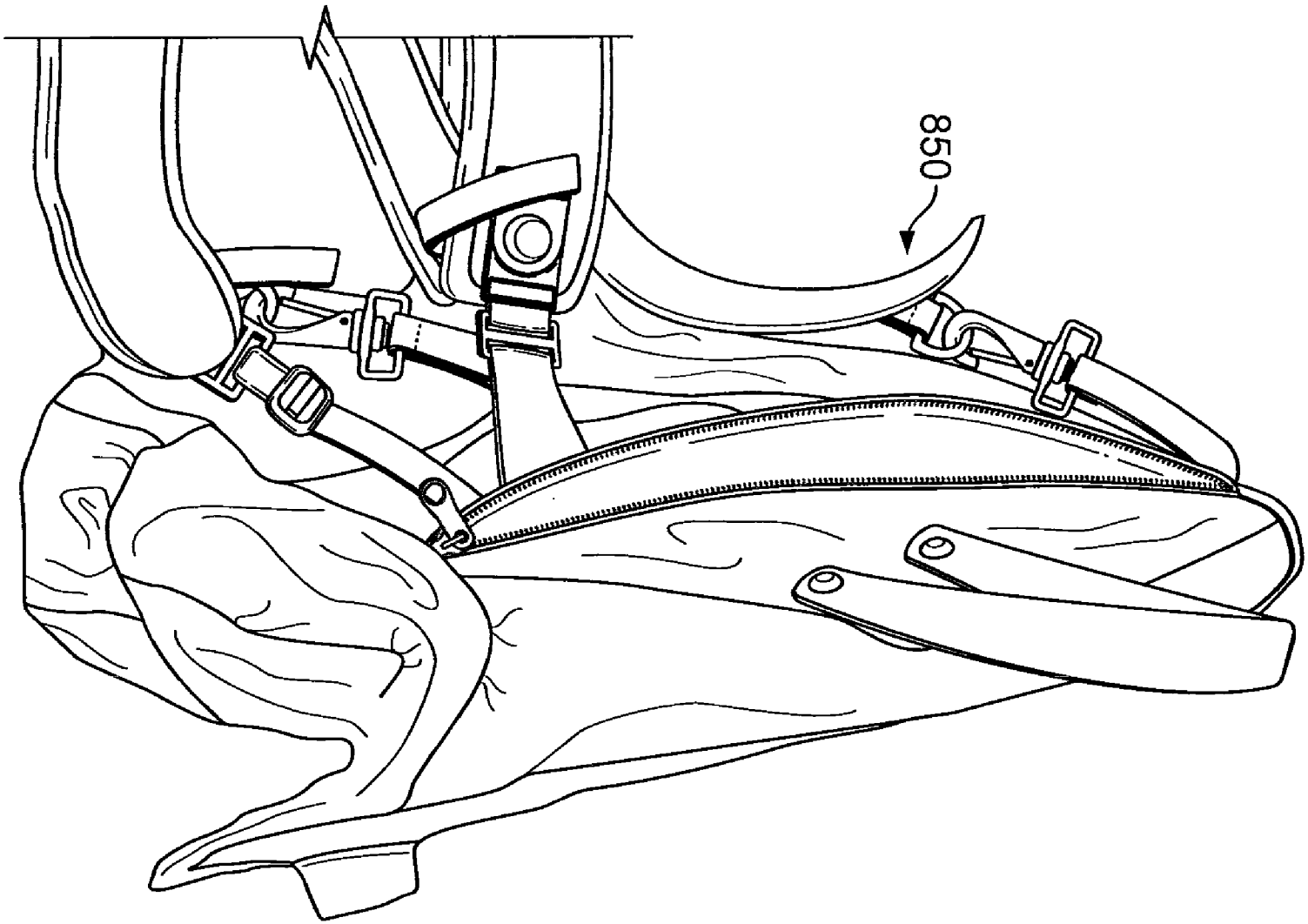
FIG. 8 is a side view of a separate padded compartment of the bag illustrating one generalized embodiment.

In one or more embodiments, bag 10 may also have padding capable of providing cushion between a user and bag 10. FIG. 7 shows a back perspective view of bag 10 with padding 750 located on the back surface of bag 10. Padding 750 may provide padding between a user and bag 10 when carried, such as a backpack. In another embodiment, there may be a separate padded compartment capable of providing cushion between a user and bag 10. FIG. 8 shows a side view of bag 10 with a separate padded compartment 850.

Figure 9:
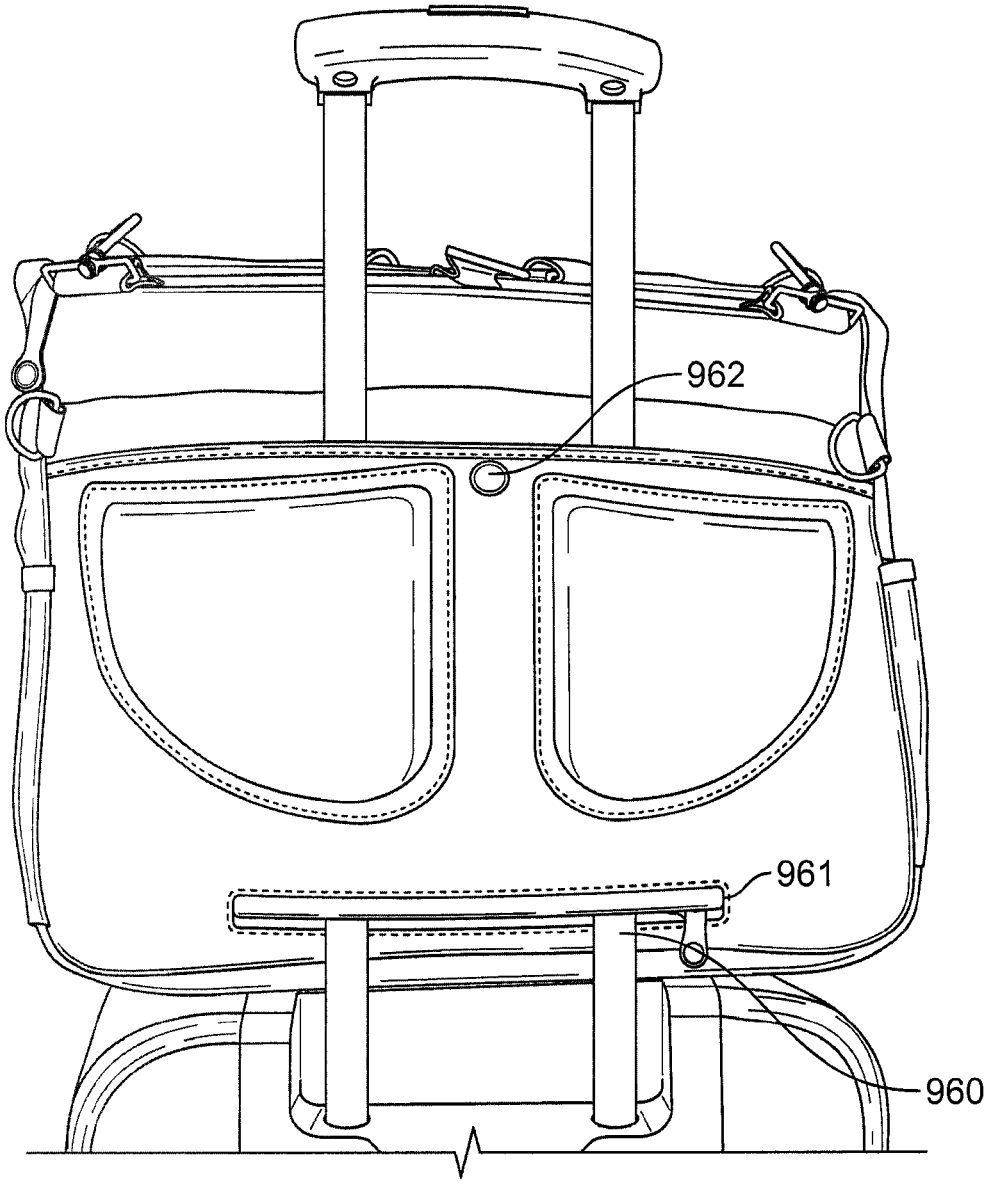
FIG. 9 is a back view of a bag showing a back panel that allows a handle of a rolling suitcase to pass therethrough, according to one generalized embodiment.

In an embodiment, bag 10 may have a panel that is capable of accepting a handle, such as a handle from a rolling style suitcase, therethrough. FIG. 9 depicts panel 960 with a handle of a rolling style suitcase therethrough. As shown in this embodiment, panel 960 is accessed at a lower portion by a zipper 961, which may be zipped open for access and zipped closed when not in use. In this embodiment, there also is a snap 962 located at the upper portion of the panel, which may be opened to accept the suitcase handle therethrough and closed to help prevent the suitcase handle from moving side to side within panel 960. One of ordinary skill will appreciate that panel 960 may be closed at its upper and/or lower portions by other fasteners or means, or does not necessarily need to be closed at all. By panel 960, the invention provides for another way of carrying bag 10.

To convert carrying system 20 from a configuration having two strap portions into a single strap, a user may employ the following method. As shown in FIG. 2, unbuckle buckle 225, unattach secondary strap 326, as shown in FIG. 3*a* and unfold strap 21 as shown in FIG. 3*b*. As shown in FIG. 4, carrying system 20 is now configured as a single strap 21, which may be adjusted in length (also shown in FIGS. 5 and 6). To convert carrying system 20 from a single strap to having two strap portions, a user may fold strap 21, attach secondary strap 326, and fasten buckle 225.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting.

What is claimed is:

1. A carrying system capable of being used to carry a bag, comprising:

a strap having two ends, first and second opposing faces, and a mid-section;

a first and second connector attached at respective ends of said strap at complementary and opposite locations, wherein said strap is capable of being attached to said bag at said connectors for carrying said bag, and wherein said strap is capable of being folded substantially at or near said mid-section and removably attached to said bag substantially at or near said mid-section to form more than one strap portion capable of being used to carry said bag; and a secondary strap having a first and second end, wherein said first end of said secondary strap is connected to said first face of said strap substantially at or near said mid-section of said strap, and wherein said second end of said secondary strap is releasably connected via a fastener to said second face of said strap on a substantially opposite side of the mid-section compared to where said first end of said secondary strap is connected to said first face of said strap so that when said strap is folded substantially at or near said mid-section to form more than one strap portion and said second end of said secondary strap is connected to said second face of said strap, said secondary strap helps maintain said fold in said strap.

2. The carrying system of claim 1, wherein said folded strap comprises a substantially "U" shape.

3. The carrying system of claim 1, further comprising a buckle connected to said bag wherein said buckle is capable of removably attaching said strap to said bag substantially at said mid-section.

4. The carrying system of claim 1, further comprising an adjuster connected to said strap that is capable of being used to adjust the length of said strap.

5. The carrying system of claim 1, wherein said bag is capable of being carried as a backpack by said more than one strap portion.

6. The carrying system of claim 1, wherein the connector comprises at least one of a clip, "J" hook, ring, and swivel hook.

7. The carrying system of claim 1, wherein the fastener comprises at least one of a snap, hook and loop fastener, button, buckle, clip, loop, hook, swivel hook, releasable loop, and carabiner.

8. The carrying system of claim 1, wherein said folded strap comprises a substantially "V" shape.

9. The carrying system of claim 8, wherein the "V" shape forms an angle that is between at least about 40 degrees and at least about 100 degrees.

10. The carrying system of claim 8, wherein the "V" shape forms an angle that is greater than at least about 60 degrees.

11. The carrying system of claim 8, wherein the "V" shape forms an angle that is less than at least about 100 degrees.

12. A method for converting a carrying system from a strap comprising one uniform strap portion to a strap comprising more than one strap portion, wherein the strap has first and second opposing faces, is configured to be used to carry a bag and is attached substantially at its ends to the bag, the method comprising:

removably attaching a mid-section of the strap to the bag so that the strap comprises more than one strap portion, wherein the mid-section is located between the ends of the strap, and removably attaching via a connector a first portion of a secondary strap to the first face of the strap at or near the mid-section of the strap, wherein a second portion of the secondary strap is connected to the second face of the strap on a substantially opposite side of the mid-section compared to where the first portion of the secondary strap is connected to the first face of the strap.

13. The method of claim 12, wherein the mid-section located between the ends of the strap comprises a location that is substantially halfway between the ends of the strap.

14. The method of claim 12, further comprising folding the strap substantially at the mid-section before removably attaching the mid-section of the strap to the bag.

15. The method of claim 12, wherein the connector comprises at least one of a snap, hook and loop fastener, button, buckle, clip, loop, hook, swivel hook, releasable loop and carabiner.

16. The method of claim 12, wherein removably attaching the mid-section of the strap to the bag comprises engaging a mechanism for removably attaching the mid-section of the strap to the bag.

17. The method of claim 16, wherein the mechanism for removably attaching the mid-section of the strap to the bag comprises at least one of a buckle, snap, hook and loop fastener, clip, loop, hook, swivel hook, releasable loop, and carabiner.

18. A carrying system for a bag comprising:

a strap having first and second ends, first and second opposing faces, and a mid-section located between the first and second ends of the strap;

a first mechanism for removably attaching the first and second ends of the strap to substantially first and second ends of the bag, respectively, wherein the strap comprises one uniform strap portion when the first and second ends of the strap are attached to the bag;

a second mechanism for removably attaching the mid-section of the strap to the bag, wherein the strap comprises more than one strap portion when the first and second ends and the mid-section are attached to the bag; and a secondary strap having a first and second end, wherein the first end of the secondary strap is connected to the first face of the strap substantially at or near the mid-section of the strap, and wherein the second end of the secondary strap is configured to be releasably connected via a connector to the second face of the strap on a substantially opposite side of the mid-section compared to where the first end of the secondary strap is connected to the first face of the strap.

19. The carrying system of claim 18, wherein the first mechanism comprises at least one of clips, "J" hooks, rings, and swivel hooks.

20. The carrying system of claim 18, wherein the second mechanism comprises at least one of a buckle, snap, hook and loop fastener, clip, loop, hook, swivel hook, releasable loop, and carabiner.

21. The carrying system of claim 18, wherein the first mechanism is different from the second mechanism.

22. The carrying system of claim 18, wherein the mid-section located between the first and second ends of the strap comprises a location that is substantially halfway between the first end and the second end of the strap.

23. The carrying system of claim 18, further comprising an adjuster connected to the strap, wherein the adjuster is capable of adjusting a length of the strap.

24. The carrying system of claim 18, wherein the bag is capable of being carried as a backpack when the strap comprises more than one strap portion.

25. The carrying system of claim 18, wherein the connector comprises at least one of a snap, hook and loop fastener, button, buckle, clip, loop, hook, swivel hook, releasable loop, and carabiner.

* * * * *